US012648591B2

(12) United States Patent
Isozaki

(10) Patent No.: US 12,648,591 B2
(45) Date of Patent: Jun. 9, 2026

(54) ELECTRONIC INGESTIBLE GAS COOLER

(71) Applicant: Christopher Dan Isozaki, Rancho Palos Verdes, CA (US)

(72) Inventor: Christopher Dan Isozaki, Rancho Palos Verdes, CA (US)

( * ) Notice: Subject to any disclaimer, the term of this patent is extended or adjusted under 35 U.S.C. 154(b) by 283 days.

(21) Appl. No.: 17/705,277

(22) Filed: Mar. 26, 2022

(65) Prior Publication Data

US 2022/0338533 A1 Oct. 27, 2022

Related U.S. Application Data

(60) Provisional application No. 63/166,835, filed on Mar. 26, 2021.

(51) Int. Cl.

| | |
|---|---|
| ***A24F 1/30*** | (2006.01) |
| ***A24F 1/32*** | (2006.01) |
| ***A24F 5/00*** | (2006.01) |
| ***F25B 21/04*** | (2006.01) |

(52) U.S. Cl.

CPC ..... *A24F 1/30* (2013.01); *A24F 1/32* (2013.01); *A24F 5/00* (2013.01); *F25B 21/04* (2013.01)

(58) Field of Classification Search

CPC .... A24F 1/30; A24F 5/00; F25B 21/02; F25B 21/04

See application file for complete search history.

(56) References Cited

U.S. PATENT DOCUMENTS

| | | | | |
|---|---|---|---|---|
| 2,827,903 | A | 3/1958 | Niederman | |
| 3,084,698 | A | 4/1963 | Smith | |
| 4,014,353 | A | 3/1977 | Kahler | |
| 4,029,109 | A | 6/1977 | Kahler | |
| 4,111,213 | A * | 9/1978 | Shanto | A24F 1/30 131/210 |
| 4,164,950 | A | 8/1979 | Bechtold | |
| 4,216,785 | A | 8/1980 | Erickson | |
| 4,253,475 | A | 3/1981 | Schreiber | |
| 5,464,026 | A | 11/1995 | Gardner | |
| 10,986,864 | B1 * | 4/2021 | Arabia | A24F 1/06 |
| 2014/0130812 | A1 * | 5/2014 | Kling | A24F 1/30 131/173 |
| 2016/0044960 | A1 | 2/2016 | O'Connor | |
| 2016/0157520 | A1 * | 6/2016 | Alfawaz | A24F 1/30 131/226 |
| 2017/0172203 | A1 * | 6/2017 | Gebara | A24D 1/14 |

* cited by examiner

*Primary Examiner* — Lionel Nouketcha
(74) *Attorney, Agent, or Firm* — STETINA GARRED BRUCKER & NEWBOLES

(57) ABSTRACT

An electronic ingestible gas cooling device that reduces the temperature of a gas (e.g smoke, vapors) before being ingested while simultaneously solving or minimizing problems such as user discomfort from too much heat, preparation inconvenience, changing gas temperature over time and/or changing the flavor or potency experience.

The device cools by improving the transfer of heat away from the hot gas using a combination of an electrically powered thermoelectric cooling device (8), water, heat distribution device (2), fan (10) and an elongated cooling path (4,5) designed to increase the time and the amount of surface area contact between the gas and the cool surface.

20 Claims, 8 Drawing Sheets

ELECTRONIC INGESTIBLE GAS COOLER

CROSS REFERENCES

Non-Provisional patent application number: 63/166,835 by inventor Christopher Isozaki

BACKGROUND OF THE INVENTION

Field of the Invention

This invention relates to cooling ingestible gases in a gas consumption system. The process is commonly referred to as smoking but it now encompasses more than igniting a plant substance and breathing in the smoke. It has expanded to include breathing in vapors created by a variety of processes such as e-cigarettes, atomizers or vaporizing substances like waxes or liquids by heating them enough to start vaporizing. The process can be generically called the consumption of ingestible gas.

Description of the Related Art

Historically, there have been many attempts to cool ingestible gas.

Early attempts to cool smoke was by adding a filter as in U.S. Pat. No. 2,827,903 in 1956. The filter did provide a small amount of cooling because it could absorb some of the heat and it was not as effective as people would want but it was inexpensive, easy to implement and did not place any additional burdens on the user.

Other attempts used water to serve as a cooling agent by passing the gas through. This was true of many water pipes, also called bongs. The water method of cooling was used in U.S. Pat. No. 4,253,475A but we know it wasn't effective enough because of the quantity of innovations and changes in the marketplace to offer the water more effective cooling.

Another attempt to cool the smoke was to add a secondary tube that would allow more ambient air to mix with the smoke. This method was used in U.S. Pat. No. 4,216,785. The major issues with this method include changing the concentration of any active ingredient because of the additional volume of air and the inability to cool the gas below ambient air temperature.

Another attempt to cool the smoke was to elongate the path that the smoke travels and possibly change the material of the path to conduct more heat away, also known as cooling, from the smoke. This method was used in U.S. Pat. No. 5,464,026. This method can cool the smoke but still has the limitation of only reaching a minimum temperature similar to the temperature of ambient air and in most cases.

Another attempt to cool the smoke was to use two independent approaches in one system, elongated path and water cooling. This method was used in U.S. Pat. No. 4,014,353A and 4029109A. The hot air is pulled through an elongated path at the beginning of the process and then the gas is sent through the water for further cooling. The elongated path still could, at best, reach ambient air temperature and the water, if not cooled through some other process, will typically reach a temperature close to the temperature of ambient air so the resultant cooling would not be sufficient to reach the desired temperature range. Also, as the person was smoking, the water temperature would increase due to the contact with the smoke and change the experience over time.

Another attempt to cool the smoke was to use ice alone to cool the gas. This method was used in U.S. Pat. No. 4,164,950 in 1979. The issues with this method were inconveniencing the user by requiring access to ice to achieve the cold temperatures and managing the ice because if it melted and the user did not have access to more, they would not have a consistently pleasant experience. Also, as the water melted, it needed to be monitored and drained so it didn't block or enter the device where the substance was heated.

Another attempt was to cool the smoke with water and ice separately as in FIG. 7. Using a water pipe with an upright neck, there was a simple modification to the neck by pinching the glass to narrow the opening in order to suspend the ice above the water. This inconvenienced the user because they had to have the initial ice and as it melted, have enough replacement ice.

Another attempt was to cool the smoke by using the cool side of a thermoelectric cooling device. This method was used in U.S. Pat. No. 3,084,698 in a pipe in 1960. The thermoelectric devices were used in-line in a pipe. One tried to use the heat from the smoke to generate electricity (Seebeck effect) and use that electricity to power another thermoelectric cooling device (Peltier effect) to cool the smoke as it passed. The problem is that the electricity generation is very inefficient and couldn't possibly provide enough electricity to the thermoelectric cooler to cool it enough to be in the goal temperature range.

Another attempt was to cool the smoke using a thermoelectric device and a liquid coolant pump to cool the smoke. This method was used in US Patent 20160044960A1. Overall, it was a much more complicated design and relied on several electronic devices which I believe increases the overall cost and more importantly, the probability of failure. Because of its complexity, it had many hoses and enclosed portions that were exposed to the smoke and would be very difficult to clean and service.

BRIEF SUMMARY OF THE INVENTION

The ELECTRONIC INGESTIBLE GAS COOLER (EIGC), in the preferred embodiment, was conceived to make the experience of ingesting smoke or vapor a more pleasant and enjoyable experience by cooling the ingestible gas and thereby minimizing any discomfort or pain during consumption. The gas is first cooled by water and then cooled as it moves through the elongated path located inside the heat collection device which is in turn cooled by a thermoelectric device (TEC), heat sink and fan. The EIGC is easy to operate, requires minimal effort to prepare, provides a consistent experience for an almost unlimited amount of time and has the ability to interface with a variety of input and output accessories and devices.

BRIEF DESCRIPTION OF THE SEVERAL VIEWS OF THE DRAWING

The drawings included in this set of documents are meant to show the features and major parts of the invention, the Electronic Ingestible Gas Cooler (EIGC), as well as how the parts would be assembled to create one or more embodiments of the system. They could be used to infer the operation of the EIGC but we recommend that the drawings be used in conjunction with the detailed description in order to understand how to build the system, operate the system, and understand how the system works. These drawings are not means to represent all the details of the system by themselves and the group of drawings included in this submission are not meant to cover all embodiments of the EIGC.

BRIEF DESCRIPTION OF THE PART NUMBERS REFERENCED IN THE DRAWINGS

FIG. 1

Figure 1:
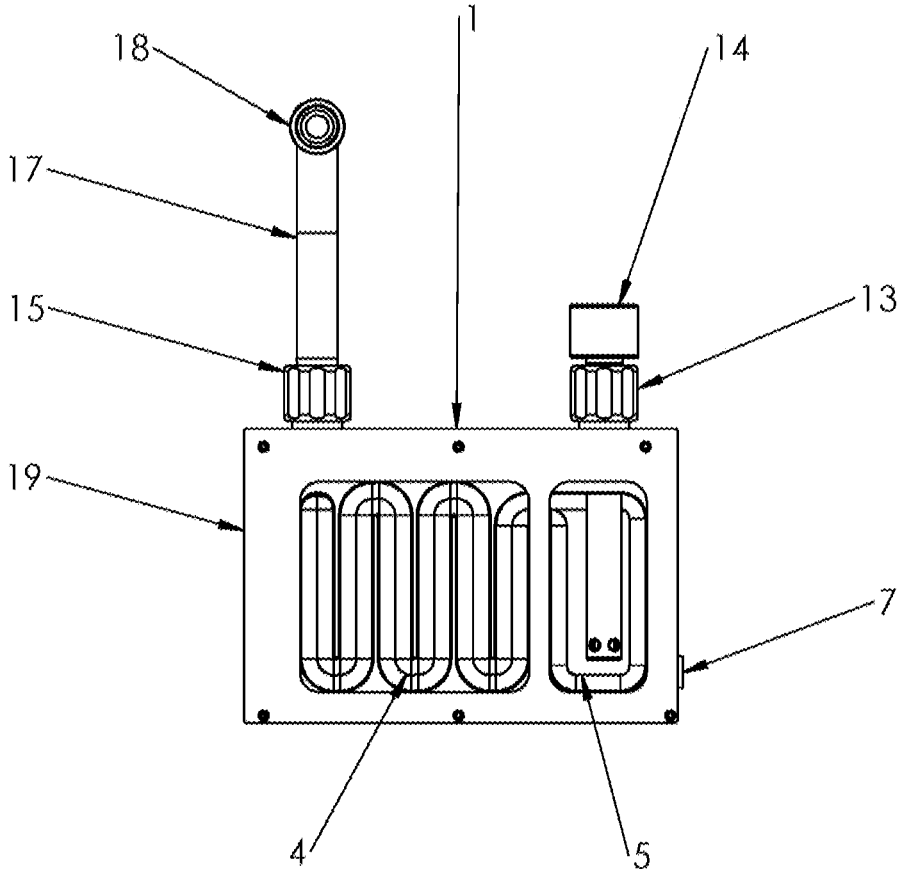
FIG. 1 is a front view of the preferred embodiment of the EIGC and is a device that is full functioning from the preparation/heating of the material through the cooling process as the gas passes through the heat collection device with the elongated path to the output device.
Figure 2:
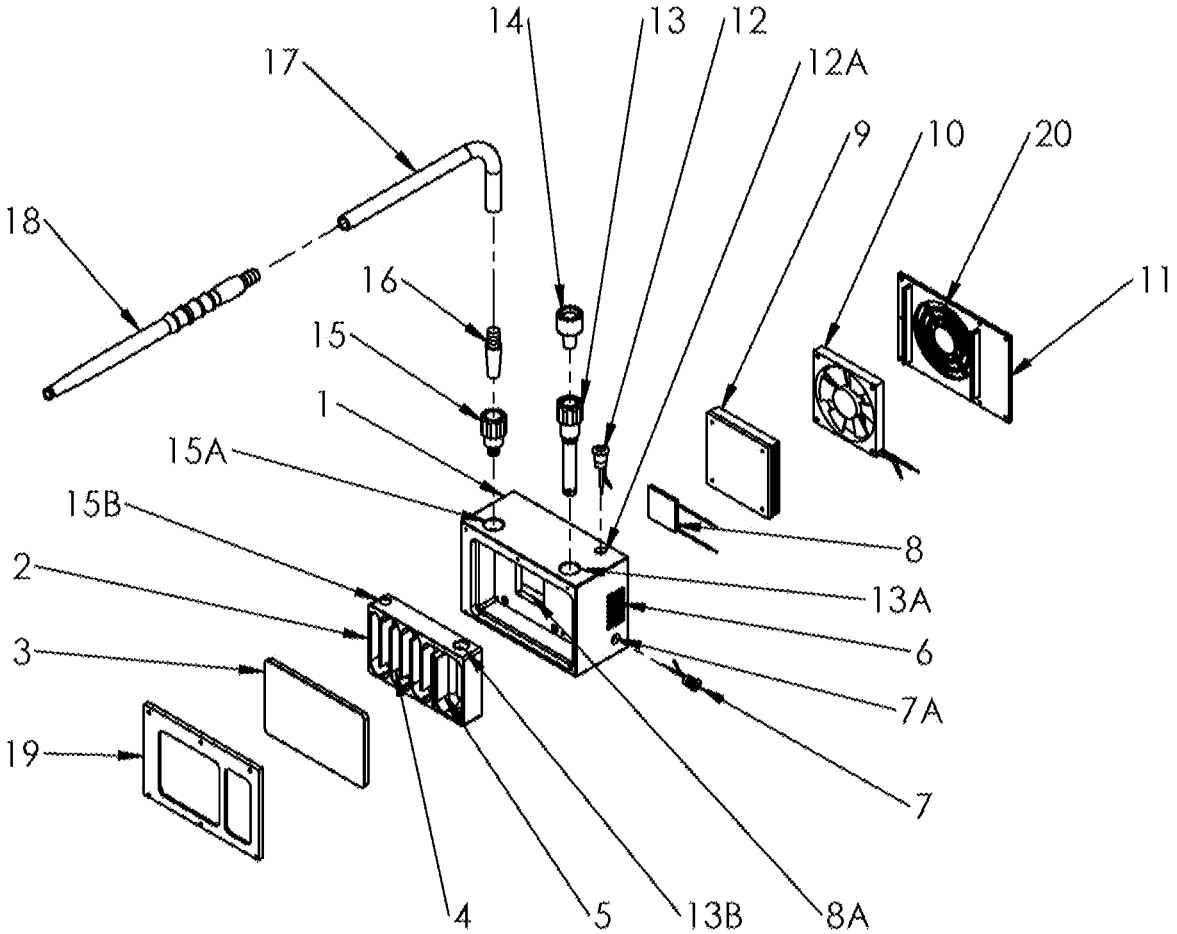
FIG. 2 is an exploded isometric view of the preferred embodiment of the EIGC with the perspective from the upper right corner. It shows the major components of the system, an idea of where the parts fit and offers a good idea of how it would be assembled.
Figure 3:
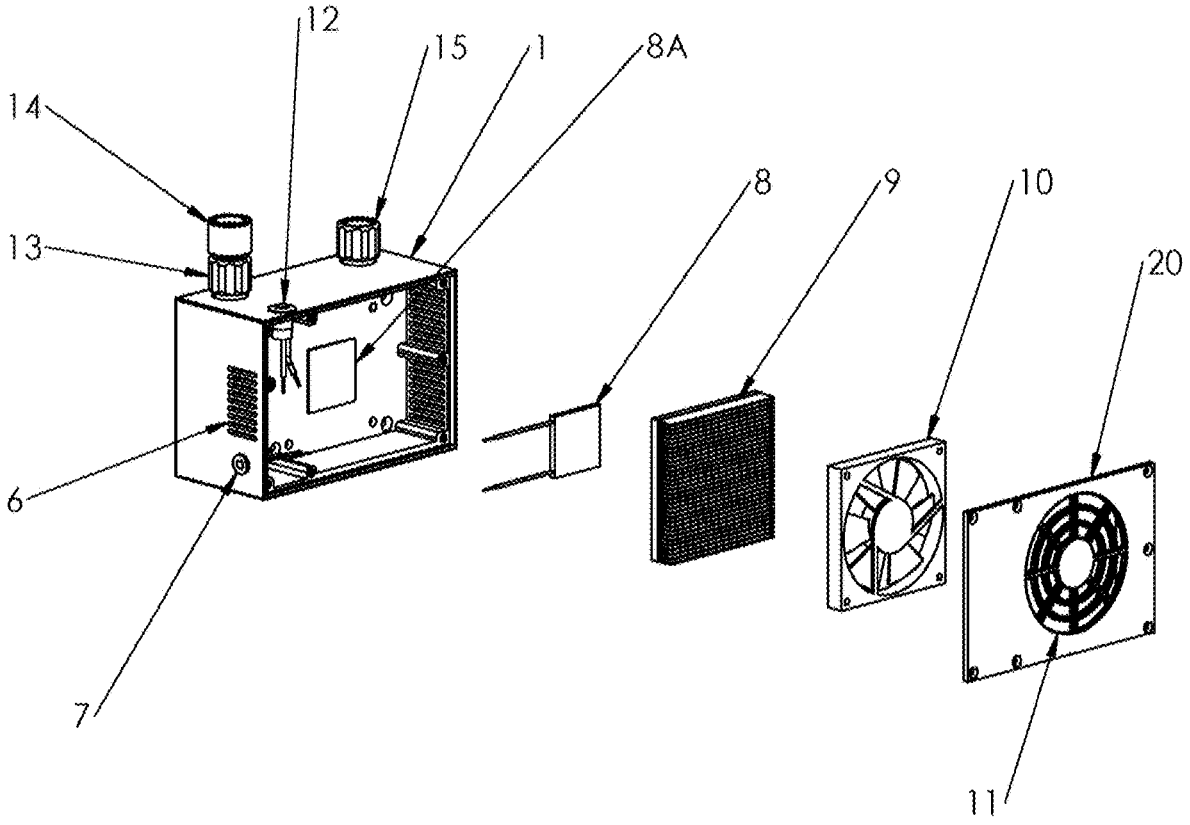
FIG. 3 is another exploded view of the preferred embodiment of the EIGC with the perspective from the upper left corner of the back. This shows the devices that participate in supporting the heat pumping ability of the thermoelectric device and its interface to the heat collection device.
Figure 4:
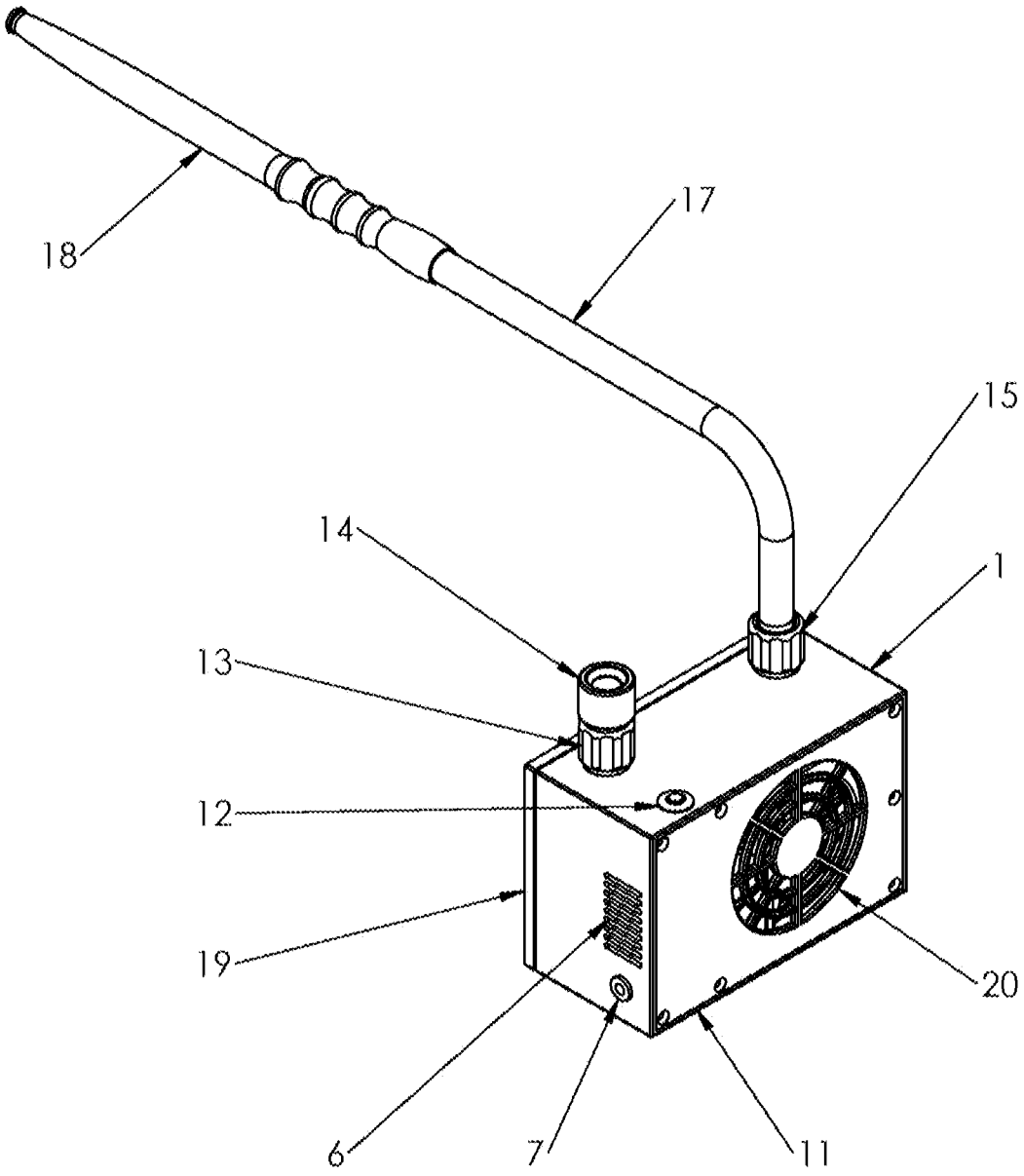
FIG. 4 is an assembled isometric view of the preferred embodiment of the EIGC from the upper left corner from the back side of the system.
Figure 5:
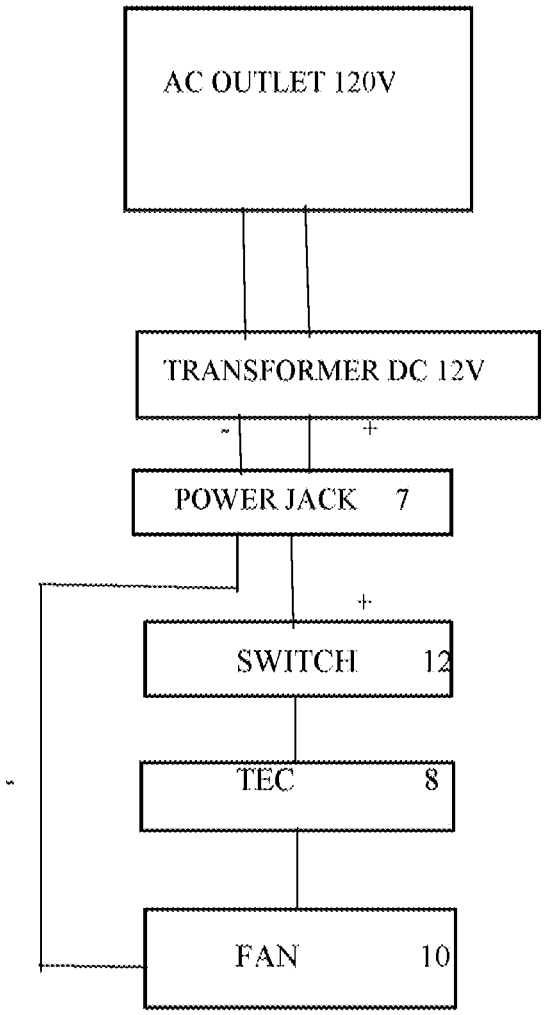
FIG. 5 is an abstracted version of how the electrical components are wired together. The electrical components include the electronic switch (12), the thermoelectric cooler (8), the fan (10), electrical power jack (7) and the A/C to 12V transformer.
Figure 6:
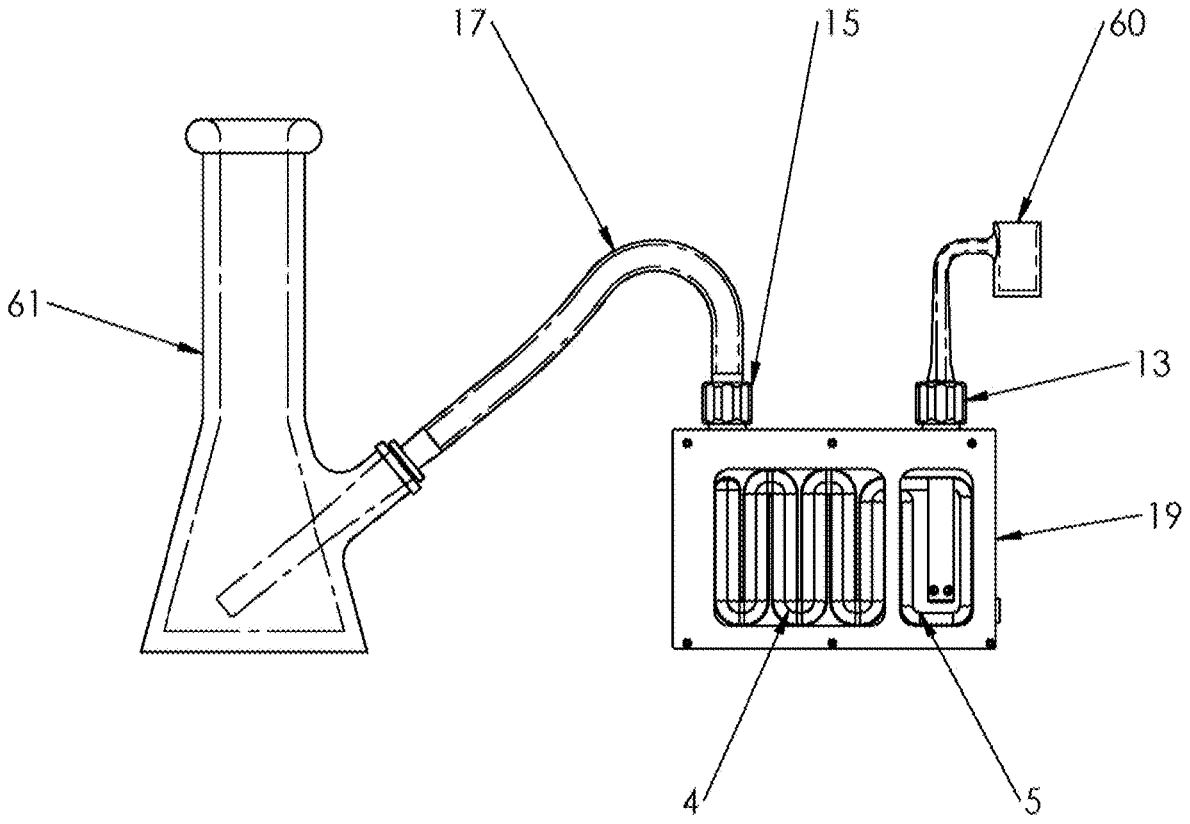
FIG. 6 is a picture depicting how the EIGC can interface with an input and preparation device called a nail (60). The nail (60) is inserted into the stem (13) and is held in place by gravity and friction. This picture also depicts how the EIGC can interface on the output side into another device like a water pipe (61). The user would use the water pipe (61) to create the suction to pull the gaseous mixture that is prepared in the nail (60).
Figure 7:
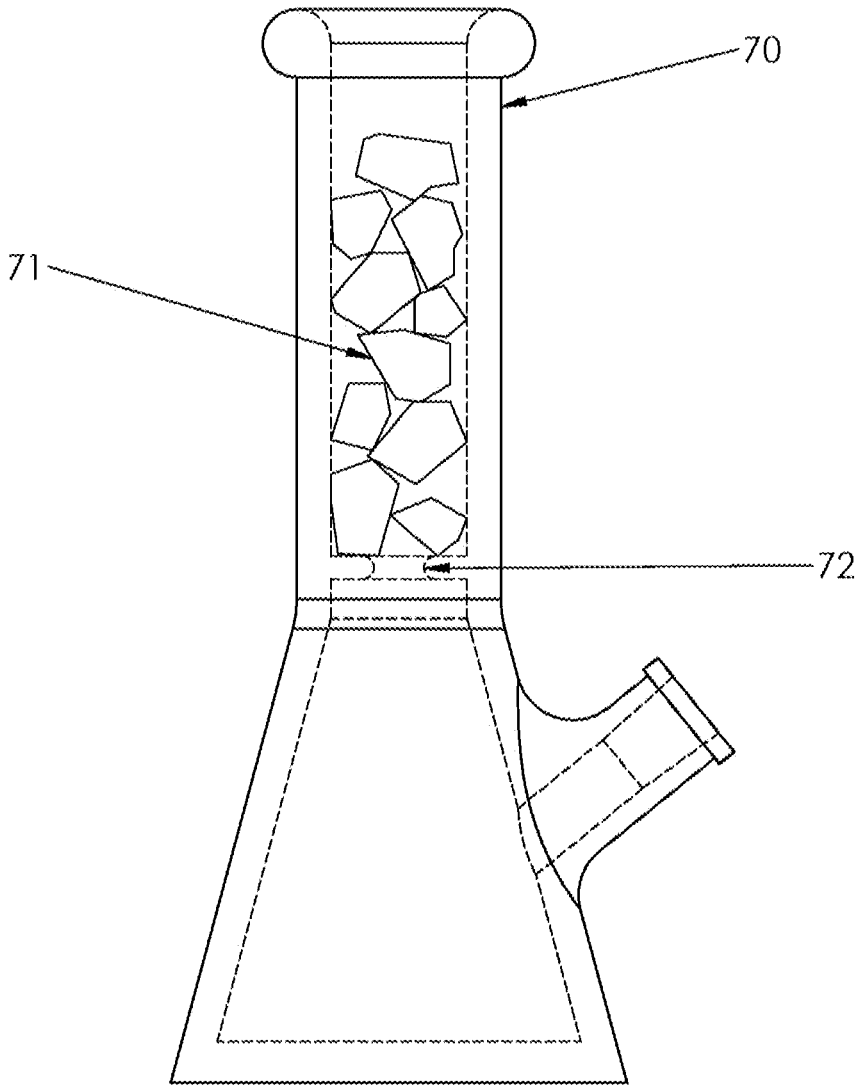
FIG. 7 is a picture of a standard water pipe with a feature called the ice catch (72) which traps ice (71) in the neck (70). This is a common method of cooling the gas.
Figure 8:
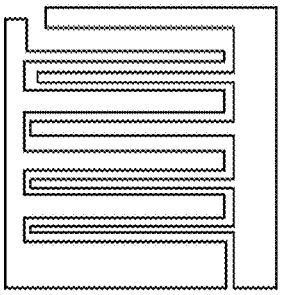
FIGS. 8-15 show a variety of the multiple types of pathways that could be used and still retain the cooling capability of the EIGC. These patterns would all be part of the heat collection device (2). It also shows that the elongated path (4) could support one or more inputs and/or one or more outputs.
Figure 9:
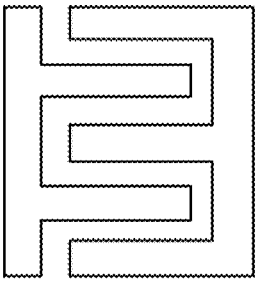
Figure 10:
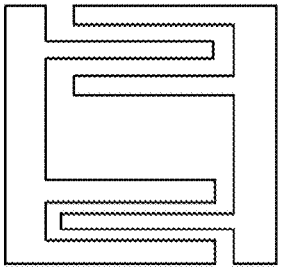
Figure 11:
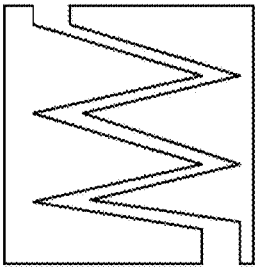
Figure 12:
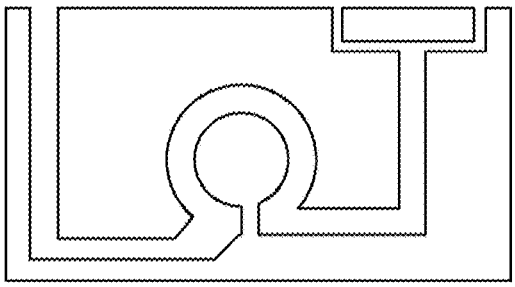
Figure 13:
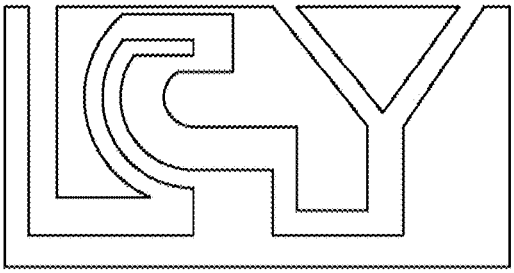
Figure 14:
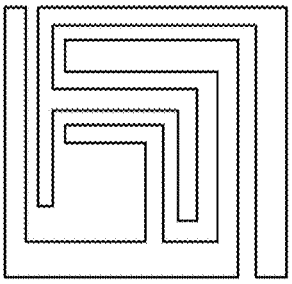
Figure 15:
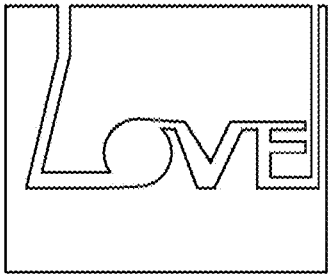

All the parts are numbered the same as in FIG. 2.

FIG. 2

These descriptions are referring to the preferred embodiment of the EIGC but is not meant to limit the number or type of embodiments of this invention.

1 The box or casing for the Electronic Ingestible Gas Cooler (EIGC).

2 The heat collection device containing the elongated path and a larger cavity to hold water for cooling and/or filtering.

3 The clear glass window for the front plate cover (19)

4 The elongated path

5 The water reservoir is an enlarged cavity for holding water on one end of the elongated path (4)

6 An air vent used to expel the warm or hot air out of the box.

7 This is an electrical connector/plug that can be used to accept an electrical connection from a 12V A/C to D/C transformer. This source provides power to all the devices in this system.

7A This is the cutout hole where the electrical connector/plug (7) is fastened to the outer shell of the box (1).

8 This is a thermoelectric cooling device that uses electricity and the Peltier effect to become a heat pump transferring heat from one side of the device to the other. One side is cool or cold and the other is warm or hot.

8A This is the box (1) inner wall cutout to support the thermoelectric cooler (8).

9 This is a heat sink.

10 This is a fan.

11 This is the back plate and is fastened to the back of the box (1)

12 This is an electronic switch that can allow the flow of electricity from the transformer or can break and circuit and not allow any electricity to feed the system

12A This is a cutout hole where the electronic switch (12) is attached to the box (1)

13 This is a stem that has an industry standard tapered adapter on the top portion that supports input and/or devices that prepare the substance for ingestion.

13A This is a cutout hole where the stem (13) goes through.

13B This is a cutout hole in the heat collection device (2) where the stem (13) is attached.

14 This is a bowl that can be connected to the stem (13) and is a device that can support the heating or burning of a substance to be ingested.

15 This is an adapter that supports a standard hookah hose connector (16).

15A This is the cutout hole in the box (1) where the hookah hose connector adapter (15) goes through.

15B This is the cutout hole in the heat collection device (2) where the hookah hose connector adapter (15) is attached.

16 This is a standard hookah hose connector that fits in the hookah hose connector adapter (15) and is held in place by gravity and friction.

17 This is hookah hose.

18 This is a hookah handle.

19 This is a front plate covering for the heat collection device (2). It also supports the clear glass window (3)

20 This is the vent cut out of the back plate (11) to allow ambient air to enter the box (1) and feed the fan.

FIG. 3

All the parts are numbered the same as in FIG. 2

FIG. 4

All the parts are numbered the same as in FIG. 2

FIG. 5

All the parts are numbered the same as in FIG. 2 except the AC OUTLET box that represents a wall outlet that accepts 2 or 3 prong plugs. The plug connects to the transformer that accepts 120V A/C current and converts it to 12V D/C current.

FIG. 6

This picture depicts how the EIGC can interface with an input and preparation device called a nail (60). The nail is inserted into the stem (13) and is held in place by gravity and friction. This picture also depicts how it can interface on the output side into another device like a water pipe (61). The user would use the water pipe to create the suction to pull the gaseous mixture that is prepared in the nail (60).

All the parts are numbered the same as in FIG. 2 except for the following:

60 This is called a nail and is a device that is typically heated by a torch and then the substance is placed in the bowl to be heated.

61 This is a standard water pipe.

FIG. 7

This is a picture of a standard water pipe with a feature called the ice catch (72) which traps ice (71) in the neck (70). This is a common method of cooling the gas.

70 This is the neck of a standard water pipe.

71 This represents ice cubes.

72 This is the ice catch that is designed to not allow the ice to drop down any further.

FIGS. 8-15

All these patterns could exist as elongated paths (4) in the heat collection device (2). They have an input and output port and the distance is at least 3 times the shortest distance from the input to the output port.

DETAILED DESCRIPTION OF THE INVENTION

It is understood that the detailed description is an attempt to robustly define the invention and that is what we are attempting to do as well as possible. Assuming that, we also assume that there can be specific details that a person of ordinary skill in the art know and can understand, evaluate and implement without any mention. Also, it is assumed that they also have knowledge of well-known terminology, methods, procedures and devices and these things do not have to be exhaustively described or explained. Unless specifically defined, the technical terminology used herein is meant to have the meaning that one having ordinary skill in the art to which the invention belongs.

It is also understood that common terms that are typically found in dictionaries or are part of societal language norms, should be interpreted in a manner that is consistent with their usage keeping in mind the context of the relevant art.

It is also understood that a considerable amount of effort is focused on using the preferred embodiment to not only show a working implementation of the invention but also to illustrate/help explain the invention. This focus, along with the descriptions and explanations are not intended to limit the number or type of embodiments that are possible. Any description of an embodiment is meant to demonstrate alternative implementations of the cooling system but are not meant to represent al of the possible embodiments of this type of system.

If any adjectives, positive of negative, are used to describe an item in the application, does not mean it is an indication of a choice either for or against said item.

The singular forms "a" "an" and "the" include the plural forms unless the context clearly indicates otherwise.

The term and/or includes any and all combinations of one or more of the associated listed items.

The terms with root words including but not limited to "include", "comprise" means that the listed items are a part of the item, concept, group or set being discussed but this does not preclude other items also being present.

The phrase "includes but is not limited to" as a preface, is meant to mean that all of the listed items are included and that there could be other items that are not listed that should also be included.

The phase "such as" is meant to have the same meaning as "includes but is not limited to" described above unless the context clearly indicates otherwise.

Glossary

"easy" will be a description of the effort that an ordinary user would be expected to exert to be able to perform a task and it should not require any specialized tools, skills or great effort.

"core functionality" will mean the EICs simultaneously contains the thermoelectric cooling device that will transfer the heat away from the heat collection device as the gas moves along the elongated path that is at least 3 times the distance from the input to the output port, the ability to support water for cooling, ability to either have or attach input and output devices, the ability to keep the heat collection device between 0.5 and 7 degrees centigrade.

substance is meant to include any liquid, gas or solid compounds and/or mixtures that would be heated, burned, vaporized, atomized to produce a gaseous mixture that can be ingested through the mouth and/or nose and in most cases, inhaled into the lungs. This could include but is not limited to tobacco, waxes, gases and liquids.

heat spreading device will mean a device that exchanges heat in one area and spreads the heat to a greater surface area. An example of a heat spreading device is a heat sink that typically accepts the heat on a small flat area and distributes or spreads the heat, typically through conduction to multiple fins that are thin and flat Other examples include but are not limited to vapor chambers and heat pipes.

DETAILED DESCRIPTION OF THE PARTS

The box (1) or casing for the Electronic Ingestible Gas Cooler (EIGC) houses many of the parts in the interior including but not limited to the heat collection device (2), thermoelectric cooing device (8), heat sink (9) and fan (10). The box (1) houses adapters like the stem (13) and the hookah hose adapter (25) that could interface with a variety of input and output devices. It also houses an electronic switch (12), an electrical connector (7) and had air vents (6). There was an interior wall that runs from the left wall to the right wall. In the wall, there is a cutout (BA) designed to allow the thermoelectric cooler (8) to contact the heat collection device (2).

In the preferred embodiment, the material is a rigid plastic that is heat resistant and rigid enough to support the necessary parts.

In other embodiments, it could be made of any material or combination of materials that provide heat resistance, enough rigidity to support the necessary parts, resistant to corrosion or damage from exposure to water, poor electrical conductor, ability to be sealed to create a waterproof and airtight chamber for the elongated path (4). This could include but is not limited to other plastics, metals such as aluminum or stainless steel, ceramics or carbon compounds. The shape does not have to be a rectangular prism and can be a cooling component of a broader system.

The heat collection device (2) containing the elongated path (4) and the water receptacle (5) has two cooling mechanisms using the water and the thermoelectric cooling device (8). The elongated path (4) is designed to increase the distance that the gas has to travel, provide a very thermally conductive surface for the gas to transfer its heat to, and provide a trough where the gas could be significantly cooled from 3 sides. The reason for not having the elongated path open on one ide is to provide the physical access for cleaning.

In this embodiment, the heat collection device (2) is made of food grade aluminum.

In other embodiments, the heat collection device (2) could be made of materials including but not limited to copper, sliver, ceramic, carbon compounds or it could have a base material with a different maternal that would touch the gas. The lining material could be attached using methods including but not limited to plating, powder coating and anodizing.

The shape of the heat collection device (2) itself could be a variety of shapes as long as it could support an elongated path, have a flat surface on the back to attach to a thermoelectric cooling device, could support a water receptacle, could support input and output adapters.

The other embodiments could also use different types of elongated paths such as on FIG. 3-15. The paths could also have one or more inputs and one or more outputs.

The glass window (4) is designed to fit in a cavity in the front plate covering (19) and because it is clear, gives the user the ability to easily see the elongated path and the water reservoir. They could see if the water needed to be replaced or if more water needed to be added, they could also see if the gaseous mixture is moving through the IGCS as expected. The glass window (3) is made of borosilicate glass and is fastened to the front plate covering (19) with a silicon adhesive.

In other embodiments, the glass window (3) could be made of other materials including but not limited to soda lime glass, tempered glass, laminated glass, quartz or even plastics including but not limited to lexan or acrylic. The glass window (3) could have other shapes and still be effective as long as it creates the watertight and airtight seal with the heat collection device (2). In other embodiments, the glass window (3) could be tinted but still clear.

The front plate cover (19) attaches to the box (1) using 4 screws in the corners. It is designed with a receptacle to hold the glass window (3). It provides a view into the elongated path (4) and the water reservoir (5).

In other embodiments, the front plate cover (19) could be opaque or translucent.

The water reservoir (5) is actually the first part of the elongated path (4) and is located next to the elongated path (4). The water reservoir is wider than the rest of the elongated path (4) so it can hold water and be the first part of the cooling process. The user has the choice of adding water and using the cooling and filtering process or using the EICS without any water.

In other embodiments, the size of the water reservoir could be changed, it could be eliminated or it could be moved to another location in the elongated path (4). If the water reservoir (5) were moved to another location on the elongated path (4), a hole on top of the heat collection device (2) could be created where the water could be added and a plug of some sort could be used to prevent water or gas from leaking from the elongated path (4).

The electrical power jack (7A) is the 12 volt DC receptacle that accepts a plug from a transformer that plugs into 110/120 volt A/C wall power and transforms it to 12 volt DC. The decision to use 12 volt was mainly to get enough power into the thermoelectric cooler so it could quickly cool the heat collection device. From the 12V current, the electricity is used to power the thermoelectric cooler (8), the fan (10) and the electronic switch (12).

In other embodiments other voltages could be chosen for all the devices or the voltages could be different for each device, if they are different, there could be step-up and/or step-down transformers in the electrical setup to match each device. The location of the electrical switch (12) could also be moved to a variety of locations on the box (1) so long as the electrical wiring can be wired safely and doesn't interfere with any of the other functions of the IGCS.

The air vent (6) located on the right side of the box (1) is an exhaust vent. The fan (10) has ambient air fed to it through the air vent (20) on the back plate (11) The fan (10) pushes the air into the heat sink (9) fins which directs the warm air stream to the vents on the right and left sides of the box (1) and then outside of the box (1) to the ambient air.

In other embodiments, the air vent (6) could be other shapes, sizes and patterns as long as it can support the flow of air coming from the fan. Also, other vents could be added to allow more air to flow cut of the box (1) The box (1) could also be redesigned to direct the air out of a different face of the box (1).

The thermoelectric cooler cutout (SA) is a designed to fit the thermoelectric cooler (8) snugly and allow it to contact the heat collection device (2) on its entire surface.

The heat sink (9) is a heat spreading device that is attached to the hot side of the thermoelectric cooler and allows the heat to transfer to the base of the heat sink (9) and continue moving to the fins (spreading) via conduction. The material for the heat sink is aluminum which has a high thermal conductivity. The heat sink is attached to the thermoelectric cooler (8) with a thermal paste.

In other embodiments, the materials could include but would not be limited to copper, silver, graphene, or diamond. The heat sink could also take on a variety of styles and configurations. Because the heat sink is a heat spreading device, you could also use heat pump like mechanisms and devices such as heat pipes or vapor chambers to spread the heat even faster.

The back plate (11) is attached to the box (1) with four screws in the corners. Its purpose is to enclose the parts in the box (1). It has a vent (20) cut out of the back plate (11). This vent (20) is where the ambient air flows into the box (1) because of the negative pressure generated by the fan (10).

In other embodiments, the size, shape and location of the vent (20) could change but it must provide enough airflow to supply the fan (0) that could in turn push through the heat sink (9) to convect the heat to the air.

The fan (10) is positioned to push air into the heat sink (9) so the air could convect the heat from the heat sink (9) and push the air, carrying the heat, out of the sides of the box (1). By convecting the heat away from the thermoelectric cooler (8) it allows the thermoelectric cooler (8) to move more heat from the heat collecting device (2), which in turn allowed the heat collecting device (2) to move more heat from the gas while in the elongated path (9).

The thermoelectric cooling device (B) is a semi-conductor based electronic device that given a source of electricity, can act as a heat pump. It is typically a thin rectangular solid piece that would move heat from one face to the other and thereby create a hot side and a cold side. The thermoelectric cooler (8) is placed between the heat collection device (2) and the heat sink (9). Between each pair of devices is a thermal paste designed to increase the heat conduction between the two devices. Once connected and fed electricity, the thermoelectric cooler (8) moves the heat from the heat collection device (2) and to the heat sink (9).

In other embodiments, there could be different thermoelectric coolers used and/or multiple thermoelectric coolers used.

The electronic switch (12) is used to change the flow of electricity from the power source to the EICS, on or off, by completing or breaking the electrical circuit at the first connection point after the electricity enters the box (1). The electricity could also be cut off or enabled where the EICS is plugged in to the A/C wall outlet or where the power cord is plugged into the electrical jack (7) on the box (1).

The stem (13) is designed to allow the attachment of a substance preparation system or device including but not limited to bowls (14), atomizers, a splitter that allows multiple bowl (14) or a nail that vaporizes wax or liquids. The top portion is an industry standard adapter that supports standard tapered glass joints from the chemical lab industry. The adapter can be made of materials including but not limited to glass, metal, ceramic or quartz or any material that is food safe and can withstand the heat from a flame or smoldering substance.

The bowl (14) is a device designed to produce smoke or some type of vapor by putting the substance in the concave part of the device. The substance is then heated or burned using some type of heating device. The bottom of the bowl has an adapter that is shaped like a standard tapered male end used in the chemical lab industry, it goes into the top of the stem (13) and is held by gravity and friction with no other fastening means. In this embodiment, it is made of food grade aluminum and can withstand the heat generated by the burning substance and simultaneously, not get hot enough to burn the user.

The hookah hose connector adapter (15) is used to interface the hookah hose connector (16) to the box (1) and enable the gas to flow from the elongated path (4) to the hookah hose (17). It is an adapter that is screwed into the hookah adapter hole (15A). The hookah hose connector (16) is placed into the hookah hose connector adapter (15) and is held in place by gravity and friction. The adapter is made of food grade aluminum.

The hookah adapter hole (15A) is where the hookah hose connector adapter (15) would be seated.

The hookah hose connector (16) fits into the hookah hose connector adapter (5) and is secured by gravity and friction. The back side of the hookah hose connector (6) can attach to a hookah hose (7).

The hookah hose (17) is a hookah industry standard food grade silicone rubber tube with a fixed diameter. The silicone rubber is heat resistant. Its purpose is to allow the gas to travel from the hookah hose connector (6) to the hookah handle (18) and next to the user. It is also an inexpensive device that is considered easily replaceable. The hookah handle (18) connects to the hookah hose (17) via a standard ribbed section at the end of the hookah handle (18) by sliding the hookah hose (17) over the ribbed section that holds via pressure and friction. It is a connection that is designed to be taken off and put back on easily and supports changing the hookah hose (17) or the hookah handle (18).

How to Assemble the Preferred Embodiment of the Electronic Ingestible Gas Cooler To assemble the front plate cover, take the glass window (3) and using a food grade silicone adhesive, attach it to the made to fit cutout in back of the front plate cover (19).

To assemble the heat collection device (2) with the box (1), take the heat collection device (2) and orient it so the path is facing away from the box (1) and the two adapter holes (13B, 15B) are on the top. Insert the heat collection device into the front cavity of the box (1) and keep pushing until it is flush with the middle wall of the box (1). Turn the box (1) around and insert the 4 screws in the corners of the heat collection device (2).

To attach the pre-assembled front plate cover to the box (1), spread the silicone adhesive around the inside edge of the front plate cover (19), align the front plate cover (19) with the front box (1) and press them together. Insert the 4 screws in the corners of the front plate cover (19) and tighten them snugly.

To assemble the components on the right side of the box (1), gather the electrical power jack (7) and the box (1). To mount the electrical power jack (7), push the side with the two wires through the hole beneath the vent (6) and seat it flush to the box (1). Take the threaded ring and attach it to the back of the electrical power ack (7) and tighten until it is firmly snugged up to the box (1). Test it by wiggling the wire and seeing if there is any movement in the electrical power jack (7).

To assemble the components related to the thermoelectric cooling process, gather the thermoelectric cooler (8), 12V transformer, heat sink (9) and fan (10) along with the thermal compound. Connect the two wires from the 12V transformer to the thermoelectric cooler (b) and after 5 to 10 seconds, feel which side is hot and which is cold and nark it with a dot. Take the box (1) and have the back cavity facing you. Orient the thermoelectric cooler (8) with the cool side facing the heat collection device (2). Take the thermal compound, which is paste-like and spread it on the thermoelectric cooler like spreading butter and make sure it reaches everywhere on the square wafer surface. Take the thermoelectric cooler (8) and place the cool side with the paste against the heat collection device (2) through the thermoelectric cooler cutout (8A). As you lightly press the thermoelectric cooler (8) toward the heat collection device (2), wiggle it a little to aid with spreading the thermal compound. Place and spread the thermal compound on the warm side of the thermoelectric cooler (B). Take the heat sink (9) and place a very thin layer of the thermal compound on the center portion of the flat side of the heat sink (9) about the size of the thermoelectric cooler (approximately 40 mm square). Take the flat side of the heat sink (9) that contains the thermal compound and press it against the warm side of the thermoelectric cooler (8). Wiggle the heat sink (9) a little to help spread the thermal compound. Take the fan and attach it to the 12V transformer to see which direction it is blowing. Next, align the fan (10) over the fin side of the heat sink (9) so the fan (10) is blowing into the fins of the heat sink (9). Take the 4 screws and thread them through the holes in the heat sink (9) and into the pre-drilled holes in the middle wall of the box (1). Tighten them to be snug but not tight as this could damage the thermoelectric cooler (8) or fan (10).

To assemble the electrical system, identify the wires for the thermoelectric cooler (8), fan (10) electrical switch (12) and the electrical power jack (7) along with solder and a soldering tool. The devices are currently wired in a serial fashion starting with the + side wire coming out of the electrical power jack (7) and into the electrical switch (12, then the – side coming out of the electrical switch (12) and connecting to the + side of the thermoelectric cooler (8), then the – side coming out of the thermoelectric cooler (S) and into the + side of the fan (10) and finally from the – side of the fan (10) back to the – side of the electrical power jack (7). Make all the connections with solder and pack the wiring into the back cavity. The wiring should correspond to FIG. 5. Finish the back of the box (1) by putting on the back plate and testing. Make sure that the wires are packed into the back of the box (1). Take the back plate (11) and align the vent (21) with the fan (10). Place the 4 screws in the corners of the back plate (11) and screw in snugly.

Attach the adaptors by collecting the stem (13), the bowl (14), the hookah connector adaptor (15), hookah hose connector (16), hookah hose (17) and the hookah handle (18). Take the stem (13) and screw it into the stem mounting hole (13A) Take the hookah connector adaptor (15) and screw it into the end user hole (15A). Take the bowl (14) and place it into the upper opening on the stem (13). Take the hookah hose connector (16) and attach it to the hookah hose (17) by pressing it together over the ridges Take the tapered side of the hookah hose connector (16) and place it in the hookah hose connector adaptor (15). Lastly, take the hookah hose (17) and push it onto the ridged connection on the hookah handle (18). All the adaptors for the input and output should be in place.

Start testing by plugging the 12V transformer into the wall outlet. The device should start in the off mode. If we press the electronic switch (12), the sound from the fan (10) should be apparent and the light on the electronic switch should be on. Place hands on the right and left sides of the box (1) near the vents (6) and the airflow should be pushing out of both sides and the air should be warm. Place hand on the vent (20) in the back and it should be pulling air into the system. Open the front plate cover (19) and place a finger on the elongated path (9) and it should feel cool. Attach the front plate cover (9). Move hands around the edges of the door to see if there are any gas leaks. Pour some water into the stem (13) opening to fill the water reservoir about halfway. Since the glass window (3) exists, it can help guide the user to fill the water to the appropriate level. Check to see if there is any evidence of water leaks in the area around the water reservoir (10). The last step is to get a substance, place it in the bowl and light it with a lighter or hempwick and inhale the gas through the hookah handle. The gas should be cool. The movement of the gas through the water reservoir (10) and the elongated path (9) should be able to be monitored visually. Press the switch and everything should turn off and after several minutes the heat collection device (2) could be touched and it should not feel as cool.

How a User Will Operate this Embodiment of the EIGC

The user will plug in the EIGC. Press the button to turn on the device. Pour a few ounces of water into the stem (13) which will allow the water to enter the water reservoir (5). After a few minutes the device reaches the desired temperature range and is ready to deliver a cooled gas consumption experience. The user would heat or burn their particular substance and consume the gas. After the user finishes, they press the button and turn off the device.

What is claimed is:

1. A cooling system to cool a stream of ingestible gas comprising:

a connection or an adapter or an ingestible gas processing device to allow the system to produce or accept an input stream of ingestible gas, a heat collection device housing, a heat collection device positioned in the heat collection device housing, the heat collection device having a cross section defining an elongated path, the heat collection device housing having an exterior surface, an input hole formed through the exterior surface and an output hole formed in the exterior surface, the elongated path extending between the input hole and the output hole within, the elongated path of the heat collection device configured to increase both the time and the amount of surface area contact between the heat collection device and the ingestible gas as the ingestible gas passes through the elongated path, all of the ingestible gas pass passing through the elongated path moving a least 3 times the shortest distance between the input and output holes, a thermoelectric cooler, using the Peltier effect, having a cool side and a warm side, the cool side facing the heat collection device and is coupled together with the exterior surface of the heat collection device using a thin layer of a thermally conductive material, a heat spreading device that is coupled to the warm side of the thermoelectric cooler using a thin layer of thermally conductive material, an air moving device to blow air across the heat spreading device to convect heat from the heat spreading device to the ambient air, an output connection or output adapter to allow the system to allow the ingestible gas to exit the cooling system from the elongated path and continue to move towards a user, and a user interface device to allow the user to consume the ingestible gas.

2. The cooling system of claim 1, wherein the output adapter can connect to a user interface device that includes a hookah hose or a mouthpiece.

3. The cooling system of claim 1, wherein the ingestible gas processing device is a bowl, the bowl is in gaseous communication with the input hole for passing the input stream of ingestible gas through the input hole.

4. The cooling system of claim 3, wherein the bowl is made of a heat resistant material and to hold material to be processed by heating or burning.

5. The cooling system of claim 1, wherein an input adapter is connectible to another separate ingestible gas system that outputs a stream of ingestible gas selected from the group consisting of a bowl, a nail, a water pipe, an e-cigarette, a vaporizer, a cigarette and a hookah.

6. The cooling system of claim 1, wherein the heat collection device housing is made of a material selected from the group consisting of aluminum, copper, ceramic, and associated alloys.

7. The device in claim 1, wherein the elongated path has a configuration selected from the group consisting of a zigzag and a spiral to increase the distance between the input and output holes.

8. The cooling system of claim 1, wherein the heat collection device has a covering that is made of a material that is opaque, translucent or clear and the material is selected from the group consisting of glass, quartz or a plastic or some combination of opaque, translucent and clear.

9. The cooling system of claim 8, wherein the covering is made of a clear material and configured to allow visual observation through the covering of the elongated path externally from the heat collection device.

10. The cooling system of claim 8, wherein the covering is sized and configured to seal at least a portion of the elongated path in a watertight and airtight fashion.

11. The cooling system of claim 1, wherein the thermoelectric cooler is activated by a flow of electricity and has a source of electricity.

12. The cooling system of claim 11, wherein the source of electricity could either use alternating current or direct current and supplied through sources selected from the group consisting of wall power, batteries, solar, kinetic, inductive and an electrical generator.

13. The cooling device of claim 1, wherein the thermally conductive material is made of a material that increases the thermal conductivity between devices and/or objects and is in a form selected from the group consisting of a thermally conductive grease, paste, epoxy, tape or any other material that can improve the thermal conductivity.

14. The cooling system of claim 1, wherein the air moving device is selected from the group consisting of one or more fans, blowers, bellows, pressurized air system or some combination of the aforementioned devices.

15. The cooling system of claim 1, wherein the output adapter can connect to that user interface device that is selected from the group consisting of a hookah hose, a rig, or a mouthpiece and neck of a water pipe.

16. The cooling device of claim 1, wherein the heat collection device is a receptacle for containing a fluid, a portion of the elongate path extends though the receptacle.

17. A cooling system to cool a stream of ingestible gas comprising:

a connection or adapter or ingestible gas processing device to allow the system to produce or accept an input stream of ingestible gas;

a heat collection device housing, a heat collection device positioned in the heat collection device housing, the heat collection device having a cross section defining an elongated path, the heat collection device housing having an exterior surface, an input hole formed through the exterior surface and an output hole formed in the exterior surface, the elongated path extending between the input hole and the output hole, the elongated path within the heat collection device configured to increase the amount of surface area contact between the heat collection device and the ingestible gas as the ingestible gas passes through the elongated path, all of the ingestible gas pass passing through the elongated path moving a least 3 times the shortest distance between the input and output holes;

a thermoelectric cooler, using the Peltier effect, having a cool side and a warm side, the cool side facing the heat collection device and is coupled together with the exterior surface of the heat collection device;

a heat sink coupled to the warm side of the thermoelectric cooler, the heat sink being sized and configured to transfer heat from the heat collection device housing;

an air moving device to blow air across the heat collection device to convect heat from the heat spreading device to the ambient air;

an output connection to allow the system to allow the ingestible gas to exit the cooling system from the elongated path and continue to move towards a user; and a user interface device to allow the user to consume the ingestible gas.

18. The device of claim 17, wherein the ingestible gas processing device is a bowl, the bowl is in gaseous communication with the input hole for passing the input stream of ingestible gas through the input hole.

19. The device of claim 18, wherein the bowl is configured to hold material to be processed by heating or burning.

20. The device in claim 17, further includes an output adapter in gaseous communication with the output hole to allow the cooled ingestible gas to exit the cooling system from the elongated path.

* * * * *